United States Patent [19]

Wuchter

[11] 4,455,839

[45] Jun. 26, 1984

[54] COMBUSTION CHAMBER FOR GAS TURBINES

[75] Inventor: Gerhard Wuchter, Wolfschlugen, Fed. Rep. of Germany

[73] Assignee: Daimler-Benz Aktiengesellschaft, Fed. Rep. of Germany

[21] Appl. No.: 188,458

[22] Filed: Sep. 18, 1980

[30] Foreign Application Priority Data

Sep. 18, 1979 [DE] Fed. Rep. of Germany ..... 2937631

[51] Int. Cl.[3] ..... F02G 3/00

[52] U.S. Cl. ..... 60/737; 60/747; 60/749; 60/753

[58] Field of Search ..... 60/737, 750, 746, 753, 60/749, 738, 747, 741

[56] References Cited

U.S. PATENT DOCUMENTS

| | | | |
|---|---|---|---|
| 2,979,899 | 4/1961 | Salmon et al. | 60/746 |
| 3,048,014 | 8/1962 | Schmidt | 60/746 |
| 3,946,553 | 3/1976 | Roberts et al. | 60/746 |
| 3,973,390 | 8/1976 | Jeroszko | 60/737 |
| 4,030,875 | 6/1977 | Grondahl et al. | 60/753 |
| 4,062,182 | 12/1977 | Fehler et al. | 60/737 |
| 4,171,612 | 10/1979 | Zwick | 60/749 |
| 4,199,934 | 4/1980 | Meyer | 60/737 |

OTHER PUBLICATIONS

"Direction of Development in Automobile Technology", 2nd Annual Conference of the VDI-Society Vehicle Technology, TUV Rheinland GmbH, Berlin, Nov. 10–12, 1976, pp. 300–303.

*Primary Examiner*—Leonard E. Smith
*Assistant Examiner*—Jeffrey A. Simenauer
*Attorney, Agent, or Firm*—Craig & Burns

[57] ABSTRACT

A combustion chamber for gas turbines, especially for motor vehicles, which includes a first reaction chamber, an outlet opening of which terminates in a second coaxially disposed reaction chamber. Each reaction chamber is associated with a premixing chamber provided with an air inlet and a fuel injection nozzle. An insert surrounds the first reaction chamber and its premixing chamber and projects into a flame tube. The flame tube encompasses the second reaction chamber and an outer wall of the insert forms with an inner wall of the flame tube an annular premixing chamber for the second reaction chamber. Several fuel injection nozzles are arranged in a zone of the air inlet of the second reaction chamber.

12 Claims, 1 Drawing Figure

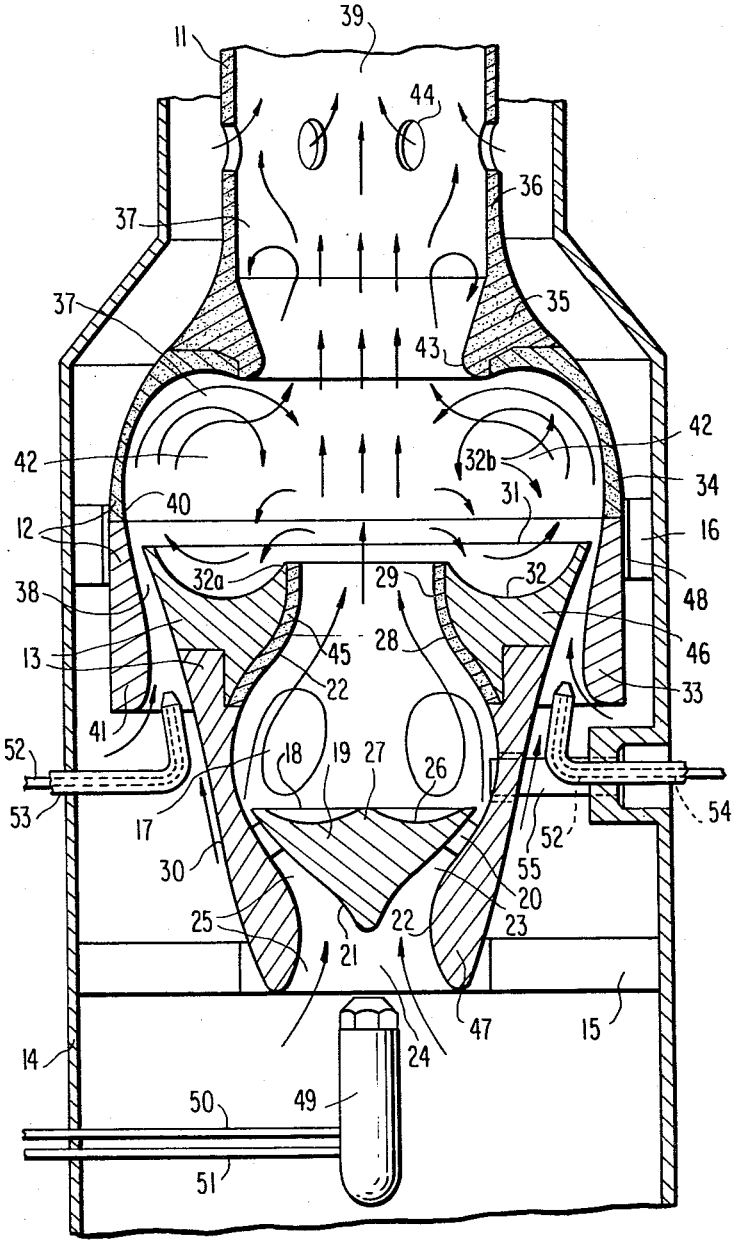
39
11
44
36
37
37
35
43
42
42
32b
34
40
31
12
16
32a
29
32
38
48
45
28
46
13
22
33
41
52
18
19
27
26
53
17
54
52
30
55
20
25
22
23
21
47
15
14
24
50
49
51

COMBUSTION CHAMBER FOR GAS TURBINES

The present invention relates to a combustion chamber and, more particularly, to a combustion chamber for gas turbines for motor vehicles which includes a first reaction chamber having an outlet opening terminating in a second coaxial reaction chamber, with each reaction chamber being associated with a premixing chamber provided with an air inlet and fuel injection nozzle.

The purpose of subdividing a combustion chamber into two reaction chambers is so that a combustion process may be obtained over a wide operating range of the gas turbine which results in the least amount of emissions of deleterious substances.

A combustion chamber of the aforementioned type is proposed in "Entwicklungslinien in der Kraftfahrzeugtechnik" (Direction of Development in Automobile Technology) status seminar dated November 10–12, 1976, in Berlin, issued by BMFT (Federal Ministry for Research and Technology) and VDI (German Engineer's Association) entitled Working Team Automobile Technology, page 302 right-hand side of FIG. 4 wherein a premixing chamber, arranged obliquely beside the first reaction chamber, unilaterally terminates in a zone of a constriction between two cylindrical reaction chambers.

The aim underlying the present invention essentially resides in providing a combustion chamber construction for gas turbines wherein the combustion chamber is provided with a novel configuration in order to further reduce the emission of pollutants during operation of the gas turbine.

In accordance with advantageous features of the present invention, an insert is provided which surrounds the first reaction chamber and associated premixing chamber and projects into a flame tube encompassing the second reaction chamber. An outer wall of the insert forms with the flame tube an annular premixing chamber for the second reaction chamber. In a zone of an air inlet of the annular premixing chamber, several fuel injection nozzles are arranged.

Advantages of the above-noted features of the present invention reside in the fact that the annular premixing chamber formed by the insert has a relatively large diameter thereby making it possible, in cooperation with several fuel injection nozzles, to intermix the fuel and air in an especially satisfactory fashion. At the same time, a good preliminary vaporization of the fuel even outside of the combustion zone is attained by the large area heated walls defining the premixing chamber. Enhanced by an axially symmetrical guidance of the flow in the annular chamber or duct, the second reaction chamber is supplied with a mixture of fuel vapor and air which is homogeneous to a high degree and favorably affects the subsequent combustion over the entire operating range of the gas turbine. Additionally, local temperature peaks which result from the combustion of an non-homogeneous mixture and leads to the formation of nitrogen oxides are avoided and the proportions of carbon monoxide and incombusted hydrocarbons are also lowered.

In accordance with further features of the present invention, the insert is shaped as a truncated cone having a base area which encompasses an outlet opening of the first reaction chamber and a rim surrounding the first reaction chamber which serves as a second flame holder. Advantages of these features of the present invention reside in the fact that the configuration of the insert enables an introduction of the mixture formed into the premixing chamber into the second reaction chamber along a wall zone. Additionally, such configuration provides for an advantageous arrangement of the second flame holder at the insert.

In accordance with the present invention, the walls of the flame tube forming boundaries for the second reaction chamber and a surface of the rim surrounding a cylindrically shaped outlet opening of the first reaction chamber are located on a circular ring with a substantially oval cross sectional area, whereby an annular eddy is produced surrounding the gases axially exiting from the first reaction chamber thereby resulting in a wide stability range of the flame and thereby permitting, in a desireable manner, a combustion of even lean mixtures.

Advantageously, in accordance with the present invention, the second reaction chamber passes over, downstream of a constriction, into a cylindrical section followed by a dilution zone and the fuel injection nozzle of the premixing chamber of the first reaction chamber is constructed as a pressure atomizer bypass nozzle.

Preferably, the fuel injection nozzles of the premixing chamber of the second reaction chamber are, in accordance with the present invention respectively composed of a capillary tube surrounded by an air pipe or air line.

Advantageously, the flame tube and insert of the present invention are made entirely or partially of a ceramic material.

Accordingly, it is an object of the present invention to provide a combustion chamber for gas turbines which avoids, by simple means, shortcomings and disadvantages encountered in the prior art.

Another object of the present invention resides in providing a combustion chamber for gas turbine engines which enables a significant reduction in the emission of pollutants and other deleterious substances.

Yet another object of the present invention resides in providing a combustion chamber for a gas turbine which enables the combustion of lean mixtures and provides a wide stability range of the flame.

A still further object of the present invention resides in providing a combustion chamber for gas turbines which functions realiably under all operating conditions.

Yet another object of the present invention resides in providing a combustion chamber for gas turbines which ensures the existence of a homogeneous fuel-air mixture and which favorably affects the combustion process over the entire operating range of the engine.

These and other objects, features, and advantages of the present invention will become more apparent from the following description when taken in connection with the accompanying drawing which shows, for the purposes of illustration only, one embodiment in accordance with the present invention, and wherein:

BRIEF DESCRIPTION OF THE DRAWING

The single FIGURE of the drawing is a longitudinal partially schematic cross sectional view of a combustion chamber for an automobile gas turbine engine in accordance with the present invention.

DESCRIPTION OF THE PREFERRED EMBODIMENT

Referring now to the single FIGURE of the drawing, according to this FIGURE, a combustion chamber includes a staggered flame tube 11, a frustoconical insert 13 projecting into a flaring inlet side 12 of the flame tube 11, and a combustion chamber housing 14 surrounding the flame tube 11 and the insert 13. Flanges 15, 16 are provided for enabling a coaxial fixing of the insert 13 and/or the flame tube 11 in the combustion chamber housing 14.

The insert 13 surrounds a first substantially spherical reaction chamber 17 defined in a zone of the inlet side thereof by a base area 18 of a conically shaped member 19 which serves as a first flame holder. The shaped member 19 is attached to the insert 13 by way of flanges 20. An outer surface 21 of the shaped member 19 and a surface 22 of an inner wall of the insert 13 define an annular chamber 23. A nozzle-shaped air inlet 24 provided at the insert 13 passes over into the annular chamber 23 and forms therewith a premixing chamber 25. An annular trough is formed in the base area 18 of the shaped member 19 for effecting a flow of the fuel-air mixture with a central peak being formed in the trough 26. The first reaction chamber 17 is delimited at its end opposite the trough 26 by a convex bulge. The convex bulge narrows the open end of the reaction chamber 17 sufficiently to create eddy currents, the effect of which is readily apparent and which will be discussed in detail later.

An outer wall 30 of the frustoconical insert 13 exhibits a slightly convex bulge, starting at the air inlet 24, the bulge passes over in the zone of the bulge 28 of the first reaction chamber into a slightly concave bulge. A base area of the truncated cone or frustoconical insert 13 includes a rim **32*a* surrounding an outlet opening 29 with the rim 32*a* having the shape of an annular trough 32**.

The flaring inlet side 12 of the staggered flame tube 11 includes a substantially cylindrical section 33, followed by an inwardly curved section 34, and a section 35 forming a transistion between the curved section 34 and a cylindrical section 36. The flame tube 11 surrounds a second reaction chamber 37, a premixing chamber 38 thereof, and a subsequently disposed dilution tube 39.

The insert 13, which extends into the inlet side 12 of the flame tube 11, forms with its outer wall 30 and with an inner wall 40 of the section 33 of the flame tube 11 the annular premixing chamber 38, which is provided with a nozzle-shaped air inlet 41. A main portion 42 of the second reaction chamber 37 is defined by an inner wall 40 of the section 34 of the flame tube 11 and by the trough 32 provided in the base area 31 of the frustoconical cone insert 13 in a plane passing through a longitudinal axis of the chamber 42. The second reaction chamber 37 terminates in the cylindrical section 36 of the flame tube 11 downstream of a constriction 43 formed by the section 35. The cylindrical section 36 also includes the dilution zone 39 provided with air inlet openings 44.

At least parts of the combustion chamber are formed of a ceramic material due to the subjecting of such parts to high thermal loads. Consequently, the portion of the first reaction chamber 17 which also includes the outlet opening 29 is lined by an annular wall member 45. To enable a mounting of the wall member 45 in place, the insert 13 is formed of two parts 46 and 47 which are joined, by, for example, welding or the like. While the section 33 of the flame tube 11 defining the premixing chamber 38 of the second reaction chamber 37 is made of a high temperature metallic material, the subsequent sections 34, 35, and 36 consist essentially of a ceramic material. In this arrangement, a ring 48, attached to the section 33 and connected to the flanges 16, centers the section 34 of the flame tube 11 in the housing 14.

A central pressure atomizer bypass fuel nozzle 49 with a feed line 50 and a blockable return line 51 is arranged in a zone of the air inlet 24 of the premixing chamber 25 of the first reaction chamber 17. Fuel is fed to the annular premixing chamber 38 of the second reaction chamber 37 through six capillary tubes 52 which are uniformly distributed along a circumference of the premixing chamber 38 and project into the air inlet 41, with each of the capillary tubes 52 being enclosed by an air pipe or line 53 formed of a refractory material. Air which is branched off from a compressor (not shown) of the gas turbine and further compressed by a pump (not shown) is fed in the annular duct 54 defined between the air pipe or line 53 and the capillary tube 52, whereby a fuel jet injected from the capillary tube 52 into the premixing chamber 38 is very finely distributed. A suitable ignition means 55 laterally projects into the first reaction chamber 17.

The arrows in the single FIGURE of the drawing indicate the flow characteristics ambient in the combustion chamber during operation of the gas turbine resulting in a favorable effect on the fuel preparation and subsequent low pollutant combustion. As shown in the drawing, in the first reaction chamber 17, the fuel is mixed with the air introduced through the nozzle-like air inlet 24 and preevaporated. The fuel-air mixture enters into the spherical first reaction chamber 17 bounded by the annular trough 26 along the inner wall of the chamber 17 wherein it forms an axially symmetrical annular eddy flow and is combusted. Thereupon, the combustion gases flow past the convex bulge and through the cylindrical outlet opening 29 and through the second reaction chamber 37, provided with the constriction 43, into the dilution zone 39. Simultaneously, the mixture, homogeneous to a high degree, which flows from the annular premixing chamber 38 into the second reaction chamber 37 forms an axially symmetrically annular eddy in the region of the inner wall 40 of the curved section 34 of the flame tube 11 and of the annular trough 32 of the insert 13 and is combusted. The combustion gases are entrained by the flow exiting from the first reaction chamber 17 in the axial direction and introduced into the dilution zone 39. In this connection, additional relatively small eddies are formed downstream of the constriction 43 which improve the combustion of the mixture in a zone of the inner wall 40 of the section 34.

With the combustion chamber of the present invention, the first reaction chamber 17 serves for producing gas for the basic load comprising idling and lower partial load range operation of the gas turbine engine; whereas, the second larger reaction chamber 37 takes over gas production for load changes which occur, for example, during an acceleration of the gas turbine. For this purpose, the pressure atomizer bypass nozzle associated with the first reaction chamber 17 is controlled in dependence upon a speed of a fuel pump (not shown) while a supply of fuel to the capillary tubes 52 associated with the second reaction chamber 37, and which permit a precise or fine fuel metering, is controlled separately.

During a cold starting of the gas turbine, injection is initially effected only into the premixing chamber 25 of the first reaction chamber 17 with the amount of fuel supplied being increased by blocking off the return line 51. Once the combustion in the temperature has risen to about 500° C. after ignition of the mixture in the first reaction chamber 17, fuel is injected through the capillary tubes 52 into the premixing chamber 38. The mixture formed therein is then ignited in the second reaction chamber 37. After a short period of time, the return line 51 is unblocked and the fuel injected through the pressure atomizer bypass nozzle 49 into the premixing chamber 25 of the first reaction chamber 17 is thereby limited to a fixed or stationary quantity.

While I have shown and described only one embodiment in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A combustion chamber for gas turbines, comprising a flame tube and a truncated cone-shaped insert projecting into said tube surrounding a first generally spheroidal reaction chamber and a coaxially connecting second reaction chamber, with a first premixing chamber equipped with a central fuel-injection nozzle therefor, the first premixing chamber, having an outside wall which is formed by a part of an interior side of the insert and an inside wall which is formed by a part of an outside of a coaxial conical fitting that serves as a flame holder, and another premixing chamber equipped with fuel injection nozzles, an outside wall of which is formed by a part of an interior side of the flame tube, and an inside wall of which is formed by a part of an outside of the insert, wherein the first generally spheroidal reaction chamber generally defined by the insert and fitting includes an inwardly protruding bulge proximate an outlet opening leading into the second reaction chamber, the outlet opening being surrounded by a rim including a concave trough which forms a part of the base area of the truncated cone-shaped insert and which serves as a second flame holder.

2. A combustion chamber according to claim 1 characterized in that the first and second reaction chambers are coaxially disposed, and in that an outlet opening of the first reaction chamber terminates in the second reaction chamber.

3. A combustion chamber according to one of claims 1 or 2, characterized in that the fuel injection nozzle means of the first reaction chamber is a pressure atomizer bypass fuel injection nozzle.

4. A combustion chamber according to claim 3, characterized in that the plurality of fuel injection nozzles associated with the premixing chamber of the second reaction chamber each include a capillary tube for supplying fuel to the premixing chamber and an air pipe means surrounding the respective capillary tubes.

5. A combustion chamber according to one of claims 1 or 2, characterized in that at least a portion of the flame tube and insert means are made of a ceramic material.

6. A combustion chamber according to one of claims 1 or 2, characterized in that the plurality of fuel injection nozzles associated with the premixing chamber of the second reaction chamber each include a capillary tube for supplying fuel to the premixing chamber and an air pipe means surrounding the respective capillary tubes.

7. A combustion chamber for gas turbines, comprising a flame tube and a truncated cone-shaped insert projecting into said tube surrounding a first generally spheroidal reaction chamber and a coaxially connecting second reaction chamber, with a first premixing chamber equipped with a central fuel-injection nozzle therefor, the first premixing chamber having an outside wall which is formed by a part of an interior side of the insert and an inside wall which is formed by a part of an outside of a coaxial conical fitting that serves as a flame holder, and another premixing chamber equipped with fuel injection nozzles, an outside wall of which is formed by a part of an interior side of the flame tube, and an inside wall of which is formed by a part of an outside of the insert, the first generally spheroidal reaction chamber generally defined by the insert and the fitting includes an inwardly protruding bulge proximate an outlet opening leading into the second reaction chamber, the outlet opening being surrounded by a rim which forms a part of a base area of the truncated cone-shaped insert and which serves as a second flame holder, said flame tube includes walls defining a main portion of the second reaction chamber, the outlet of the first reaction chamber being cylindrically shaped, and an inner surface of the walls defining the main portion of the second reaction chamber and a surface of a trough formed in a rim surrounding the outlet opening of the first reaction chamber generally define the boundaries of an annular space having an essentially oval cross sectional configuration in a plane passing through a longitudinal axis of the second reaction chamber.

8. A combustion chamber according to claim 7, characterized in that a constriction is provided in the second reaction chamber between the main portion and outlet end thereof, and in that the second reaction chamber has a cylindrical section disposed downstream of the constriction.

9. A combustion chamber according to claim 8, characterized in that a dilution zone is disposed downstream of the cylindrical section.

10. A combustion chamber according to claim 9, characterized in that the fuel injection nozzle means of the first reaction chamber is a pressure atomizer bypass fuel injection nozzle.

11. A combustion chamber according to claim 10, characterized in that the plurality of fuel injection nozzles of the second reaction chamber each include a capillary tube for supplying fuel to the premixing chamber and an air pipe means surrounding the respective capillary tubes.

12. A combustion chamber according to claim 11, characterized in that at least a portion of the flame tube and insert means are made of a ceramic material.

* * * * *